US007213371B1

(12) United States Patent
Vanderpan

(10) Patent No.: US 7,213,371 B1
(45) Date of Patent: May 8, 2007

(54) CLOSURE CLIP FOR PRE-HUNG DOORS

(76) Inventor: Ronald D. Vanderpan, 561 Crestfield Cir., Roseville, CA (US) 95678

( * ) Notice: Subject to any disclaimer, the term of this patent is extended or adjusted under 35 U.S.C. 154(b) by 34 days.

(21) Appl. No.: 10/971,255

(22) Filed: Oct. 23, 2004

(51) Int. Cl.
*E06B 3/32* (2006.01)

(52) U.S. Cl. ..... 49/380; 206/325

(58) Field of Classification Search ..... 49/380, 49/501, 504; 206/321, 325
See application file for complete search history.

(56) References Cited

U.S. PATENT DOCUMENTS 3,593,458 A * 7/1971 Wahlfeld et al. ..... 49/240
3,668,906 A * 6/1972 Josephart ..... 70/90
4,483,101 A 11/1984 Berzina
D319,007 S * 8/1991 Rogers et al. ..... D8/400
5,159,782 A 11/1992 Sales
5,209,017 A 5/1993 Ridge
5,562,315 A 10/1996 Sales
5,722,203 A 3/1998 Staples et al.
5,787,639 A 8/1998 Lamore, Jr.
6,170,198 B1 1/2001 Staples et al.
6,357,181 B1 3/2002 Triemstra
2004/0060241 A1 * 4/2004 Staples et al. ..... 49/380

* cited by examiner

*Primary Examiner*—Jerry Redman

(57) ABSTRACT

A closure clip for a pre-hung door comprising a barrel, a barrel extension and a generally rigid fastening tab connected to the barrel opposite the barrel extension, the fastening tab having a reveal spacer tab and a jamb secure tab, whereby in operably fastening the closure clip to the pre-hung door assembly the barrel is inserted within the lockset bore while the barrel extension is inserted within the transverse jamb bore, the fastening tab extends from the door knob bore and across a portion of a face of the door and across a portion of the strike jamb, the reveal spacer tab is inserted in the door reveal and the jamb secure tab overlays a surface of the strike jamb opposite the door reveal and overlaying the transverse jamb bore.

18 Claims, 4 Drawing Sheets

CLOSURE CLIP FOR PRE-HUNG DOORS

BACKGROUND OF THE INVENTION

1. Field of the Invention

This invention relates to pre-hung doors, and, in particular to a closure clip that will secure a pre-hung door in a closed and aligned position during shipping, delivery, and installation.

2. Description of Related Art

Prefabricated and pre-hung door and door frame units have become standard for most building construction situations. Such doors are generally preassembled and aligned or squared, i.e., pre-hung, within the frame, or jamb, at the manufacturing facility.

However, during transshipment and in installation pre-hung doors may become misaligned. In an assembled pre-hung door, the hinges generally secure the door to the hinge jamb and hold it in place, while the other jamb, or strike jamb, though attached to the head jamb, is not otherwise secured relative to the door. Thus, the strike jamb and the head jamb may move relative to the door and hinge jamb during transshipment or installation, thereby becoming misaligned.

For this reason various means have been devised for reversibly fixing doors in an aligned or pre-hung position. The simplest such means has been the use of one or two dual headed nails driven through the back of the strike jamb into the free edge of the door, thereby holding the door and the strike jamb in fixed relation.

In U.S. Pat. Nos. 5,159,782, 5,722,203, 5,787,639, and 6,170,198, various aids have been provided for fastening a pre-hung door assembly and maintaining its alignment during transshipment and installation. These disclosed aids are similar in that they comprise at least a first piece received in the back of the strike jamb and a second piece received in the door knob bore with a post extending through the lockset bore of the door.

U.S. Pat. No. 5,562,315, discloses a two-piece device for securing and retaining a pre-hung door that comprises a shaped cylindrical plug configured to fit closely in the lockset bore of a door. The plug can be moved within the bore so that a configured end engages a bore of the strike jamb, thus securing the door in a closed position. Slots provided in the configured end of the plug receive a retention tab that is inserted through the door reveal, securing the plug in position.

In using such multiple piece devices multiple steps are required to align the door components and utilize the interacting parts to fasten the assembly together. The pre-hung door assembly is therefore complicated by the requirement of attaching the multiple pieces to each other, and further, at the time of installation of the pre-hung door assembly the pieces must be separated prior to installing the pre-hung door assembly. Once they have been separated the door may becoming misaligned by handling during the installation stage.

One-piece closures have also been proposed for use in assembling pre-hung doors. In U.S. Pat. Nos. 4,483,101, and 6,357,181, similar one-piece fastening devices are disclosed comprising an elongated strap formed of a flexible material. A cylindrical member projecting from one end of the straps is adaptable for seating in the lockset bore. In both devices the flexible strap is extended from door knob bore across the face of the door and the marginal edge of the jamb. A terminal region of the strap is pulled over a portion of the jamb face for stapling to the strike jamb. U.S. Pat. No. 5,209,017, discloses a rigid polymeric one-piece retaining device for attachment to a pre-hung door assembly. The device includes a planar surface for placement against the door face and includes a cylindrical insert for placement within the door knob bore or opening in the door face. A stabilizer is attached perpendicularly to the device for location in the door reveal to assist in spacing and holding the door in a fixed position relative to the frame. The planar surface is stapled to the strike jamb by the installer.

One-piece retaining devices of the prior art have no mechanism for precisely and simultaneously aligning the door and strike jamb, thus demanding care and precision from the installer during assembly to be certain that the door and strike jamb are properly aligned and spaced before stapling. Additionally, in the flexible one-piece devices, stretching and flexing of the material during transshipment and installation can allow the door and jambs to move relative to each another, causing the door to come out of proper alignment.

Thus, there remains a need for a door fastening and closure device that reliably, easily and reversibly maintains a pre-hung door in proper alignment through shipment and installation.

SUMMARY OF THE INVENTION

The present invention provides a closure clip for use in a pre-hung door assembly of the type having a door frame comprising a hinge jamb, a strike jamb and a header jamb connecting the hinge and strike jambs, where the door comprises a hinged edge mounted to the hinge jamb and a free edge opposing the strike jamb, with a door knob bore formed in a face of the door in communication with a lockset bore formed in the free edge. In such an assembly, the space between the free edge and the lock jam defines a door reveal where the lockset bore is generally aligned with a transverse jamb bore located within the strike jamb.

The closure clip particularly comprises a barrel, a barrel extension and a generally rigid fastening tab connected to the barrel opposite the barrel extension, the fastening tab having a reveal spacer tab and a jamb secure tab, whereby in operably fastening the closure clip to the pre-hung door assembly the barrel is inserted within the lockset bore while the barrel extension is inserted within the transverse jamb bore, the fastening tab extends from the door knob bore and across a portion of a face of the door and across a portion of the strike jamb, the reveal spacer tab is inserted in the door reveal and the jamb secure tab overlays a surface of the strike jamb opposite the door reveal and overlaying the transverse jamb bore. The barrel extension has a generally elliptical cross section The closure clip may further comprise a flex joint disposed generally between the barrel and the fastening tab to provide movement of the fastening tab relative to the barrel.

The closure clip barrel may be sized to have a diameter slightly less than the diameter of a standard lockset bore and the barrel extension may have a diameter slightly less than the diameter of a standard transverse jamb bore.

Alternatively, the closure clip barrel extension may be sized to fit snugly within a standard transverse jamb bore.

In one embodiment the jamb secure tab comprises a terminal spacer ridge for resting on a surface of a strike jamb opposite the door reveal.

The closure clip preferably comprises a reveal lock formed by a space located between the barrel and the barrel extension. The reveal lock is for accepting the spacer reveal tab. More preferably, the reveal spacer tab has a tapered end for directing positioning of the reveal spacer tab into the reveal lock The barrel extension preferably comprises a ridge along the edge if the reveal lock forming a jamb stop for stopping the barrel extension at a predetermined depth and thereby helping in positioning the barrel extension within the transverse jamb bore.

These and other features and advantages of this invention are described in, or are apparent from, the following detailed description of various exemplary embodiments of the devices and methods according to this invention.

BRIEF DESCRIPTION OF THE DRAWINGS

Various exemplary embodiments of this invention will be described in detail, with reference to the following figures, wherein.

Corresponding reference numerals will be used throughout the several figures of the drawings.

DETAILED DESCRIPTION OF THE PREFERRED EMBODIMENT

The following detailed description illustrates the invention by way of example and not by way of limitation. This description will clearly enable one skilled in the art to make and use the invention, and describes what we presently believe is the best mode of carrying out the invention.

A typical pre-hung door assembly includes a door mounted in a frame. As is known, the frame includes a hinge jamb to which the door is mounted by hinges, a head jamb, and a strike jamb where the door lock assembly interacts with the frame to secure the swinging end of the door. The head jamb extends across the top of the door to connect the hinge and strike jambs.

The door of a pre-hung door assembly conventionally has a hinged edge mounted to the hinge jamb and a free edge opposing the strike jamb. A door knob bore formed in a surface of the door is in communication with a lockset bore formed in the free edge of the door, the latter opening to the strike jamb. The lockset bore is sometimes referred to as a latch bore or edge bore. The lockset bore provides a lock or latch opening and is adaptable for accommodating a suitable lock bolt or door latch (not shown).

The door knob bore, sometimes referred to as the body bore or cross bore, is conventionally about 2 and ⅛ inch in diameter, though often substantially smaller. The door knob bore is adaptable for accommodating a door knob or lock body. The longitudinal axis of the door knob bore is transverse to the face of the door and also transverse to the longitudinal axis of the lockset bore.

The space between the free edge of the door and the strike jam defines the door reveal. The lockset bore is aligned with a transverse jamb bore located within the strike jamb and directly across the door reveal from the lockset bore, thereby providing a hole in the strike jamb which in the completed door accepts a bolt from the lockset assembly, thereby securing the door in a closed relation to the strike jamb.

Figure 1:
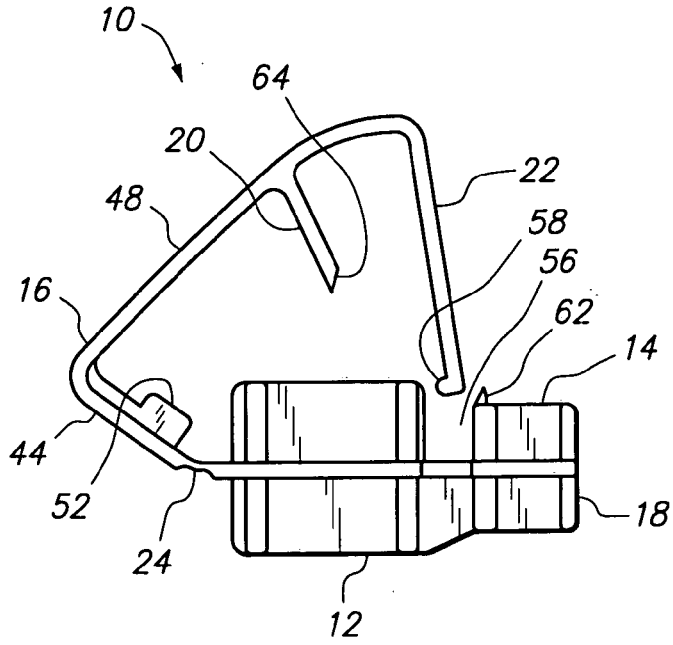
FIG. 1 is a side view of the closure clip.

Referring now specifically to the drawings, there is shown in FIG. 1 a closure clip 10 of the invention. The closure clip 10 provides a one-piece unit that is easily inserted in the lockset bore and that can remain fastened during transshipment and installation of the pre-hung door assembly in a doorway. The door is thereby maintained closed and in proper alignment with the door jambs, and, in particular, with the strike jamb.

The closure clip 10 generally comprises a barrel 12, a barrel extension 14 and a generally rigid fastening tab 16 connected to the barrel 10 opposite the barrel extension 12. The fastening tab 16 forms a semi-rigid structure that extends back and over the barrel 12 towards the barrel extension terminal end 18. The fastening tab further comprises a reveal spacer tab 20 and a jamb secure tab 22.

By semi-rigid structure, it is meant that the fastening tab 16 is generally of a rigid material sufficiently thick to withstand the stress caused by door movement during shipping and handling. Because of the rigid nature of the material forming the fastening tab 16, the closure clip reduces sag and maintains the door reveal through point of sale and even installation. When produced of a reasonably rigid plastic material, the fastening tab 16 may be formed to on order of about 11/100 of inch or less in thickness. The fastening tab will also be provided with a small amount of inherent flexibility, however, largely derived from the nature of the plastic material. This is desirable in that some flexibility in the generally rigid structure makes the closure clip easier to insert into the lockset bore and push into fastening fit with the strike jamb.

The closure clip 10 also preferably comprises a flex joint 24 disposed generally between the barrel 12 and the fastening tab 16 to provide further ease the movement of the fastening tab relative to the barrel. The flex joint 24 provides additional flexibility to the fastening tab 16 allowing easy insertion of the semi-rigid closure clip into as lockset hole. The flex joint 24 may be produced by providing or fabricating the closure clip 10 with a thinned plastic region at the fastening tab 16, or by cutting, scoring or other means known to the art.

The barrel 12 and barrel extension 14 may have a generally elliptical cross section, or may be of any other suitable shape for insertion within the lockset bore and the transverse jamb bore, respectively, of a pre-hung door assembly.

Figure 2:
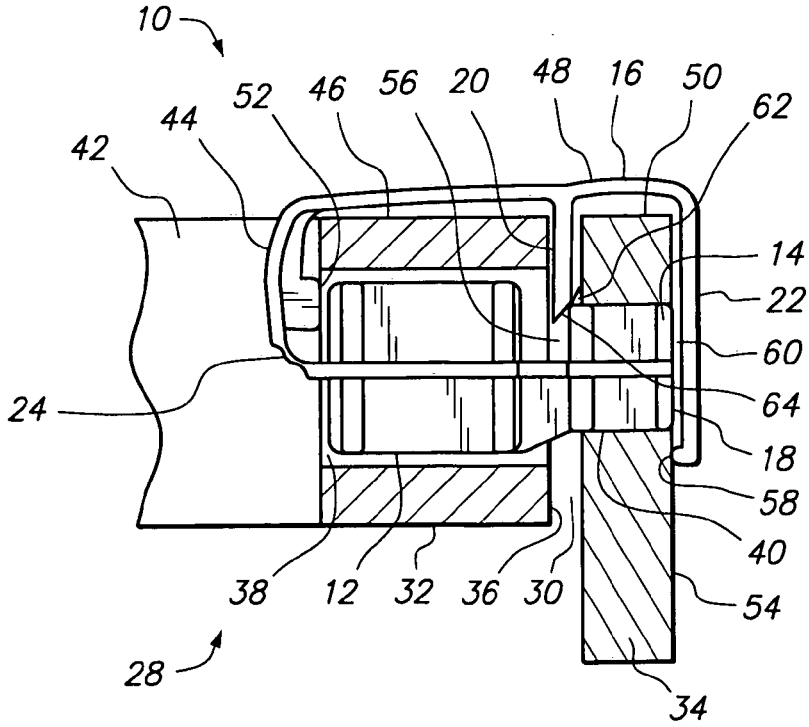
FIG. 2 is a partially cut away view of the closure clip as used to fasten a pre-hung door assembly.

As best seen in reference to FIG. 2, the closure clip 10 is fastened to a pre-hung door assembly 28 to stabilize the reveal 30 formed between the door 32 to the strike jamb 34 (shown partially cut away in FIG. 2 to reveal the placement of the closure clip 10 within the various components of the assembly 28). The closure clip 10 aligns the free edge 36 of the door with the strike jamb 34, first of all by aligning the lockset bore 38 of the door 32 with the transverse jamb bore 40 of the strike jamb 34. The barrel extension 14 is inserted through the lockset bore 38 from the door knob bore 42, and pushed through the lockset bore 38 until it is fitted into the transverse jamb bore 40 with the barrel 12 occupying the lockset bore and the barrel extension 14 occupying the transverse jamb bore 40.

A transverse region 44 of the fastening tab 16 most proximal to the flex joint 24 spans that portion of door knob bore 42 that extends from the lockset bore 38 to the door surface 46. An elongated region 48 of the fastening tab then spans that portion of the door surface 46 between the door knob bore 42 and the free edge 36 and continues across a portion of the outer strike jamb surface 50 flush with the door. With the closure clip 10 in fastening position this elongated region 48 is disposed generally parallel to the longitudinal axis of the barrel 12. A raised section 52 in the transverse region 44 of the fastening tab 16 provides additional positive placement of the closure clip 10 within the lockset hole 38.

Further in reference to FIG. 2, the reveal spacer tab 20 fits into the door reveal 52 while the jamb secure tab 22 overlays the outer surface 54 of the strike jamb 34 opposite the door reveal 30, preferably overlaying the transverse jamb bore 40.

The door reveal 30 allows free swinging of the door 32 as it opens and closes, and is conventionally about 3/32 of an inch. The reveal spacer tab 20 is preferably of nearly the same thickness, about 11/100 of an inch. Upon installation of the closure clip 10, the reveal spacer tab 20 is inserted into this reveal 30, thereby assisting in maintaining alignment of the assembly 28 during transshipment and installation.

The barrel 12 is sized to have a diameter slightly less than the diameter of a standard lockset bore 38 and the barrel extension 14 may be similarly sized to have a diameter slightly less than the diameter of a standard transverse jamb bore 40. Alternatively, the barrel extension 14 may be sized to fit more snugly within a standard transverse jamb bore 40.

The closure clip preferably comprises a reveal lock 56, i.e., a partial space formed between and separating the barrel 12 and the barrel extension 14, which will be aligned with the door reveal 30 in operation. The reveal lock 56 accepts the spacer reveal tab 20 during fastening of the closure clip 10, with the various components thereby operating as a unit to fasten and secure a pre-hung door assembly 28.

The one-piece design for the closure clip 10 allows it to be rapidly and securely fastened to a pre-hung door assembly 28. In fastening a door 32 and strike jamb 34 using the closure clip 10, the user holds the closure clip 10 by the fastening tab 16, slightly bending the fastening tab 16 at the flex joint 24. The barrel 12 is then pushed through the door knob hole 42 and lockset hole 38, until the barrel extension 14 is fitted into the transverse jamb bore 40 of the strike jamb 34. The reveal spacer tab 20 is then pushed down through the door reveal 30 and into the reveal lock 56, while the jamb secure tab 22 overlays the strike jamb 34 along its outer surface 54. While holding the jamb secure tab 22 in place, a single staple (not shown) may be placed through the jamb secure tab 22 into the outer jamb surface 54. Where the transverse jamb bore 40 extends the width of the strike jamb 34, the jamb secure tab 22 may be stapled directly into the end 18 of barrel extension 14, in which case the entire assembly is accomplished with no staples inserted into either the door 32 or strike jamb 34.

In one embodiment the jamb secure tab 22 comprises a terminal spacer ridge 58 for resting on the outer surface 54 of the strike jamb 34. This rounded ridge 58 raises the jamb secure tab 22 for ease of removal by the door installer, such as by a screwdriver inserted into the space 60 formed between the outer surface 54 of the strike jamb 34 and the jamb secure tab 22.

A stop tab 62 is provided on the barrel extension 14 towards the reveal lock 56 to prevent the barrel extension 14 from going too far into the transverse jamb bore 40, and generally provides proper positioning of the closure clip 10 so that the reveal lock 56 will properly align within the reveal 30.

The reveal spacer tab 20 may be provided with a tapered end 64 for directing the positioning of the reveal spacer tab 20 into the reveal lock 56.

As a one-piece unit, the closure clip 10 may be simply manufactured, preferably formed of a semi-rigid plastic or other suitable material, for instance a polyethylene, polypropylene or polystyrene, and can be easily fabricated by injection molding using either virgin or recycled plastic. As is seen with reference to FIGS. 3 through 8, the closure clip is designed with vertical and horizontal ribs on the barrel 12 and barrel extension 14, to reduce the quantity of material needed to fabricate the closure clip 10, thereby substantially reducing the weight of the closure clip 10. Such ribs are commonly provided to add strength in lighter weight plastic objects.

The closure clip 10 provides a low-profile clip in the form of a single unitary piece that is easier to install and remove than prior art fastening aids. The closure clip 10 can be used on inside or outside doors to reduce sag and maintain the door's reveal through point of sale and in installation. The closure clip 10 can be used on inside or entry doors, and as it is bilaterally symmetrical it can be used equally well with both right hand and left hand swing doors. The closure clip 10 is easier than prior fastening devices to install and remove from a pre-hung door assembly.

Figure 3:
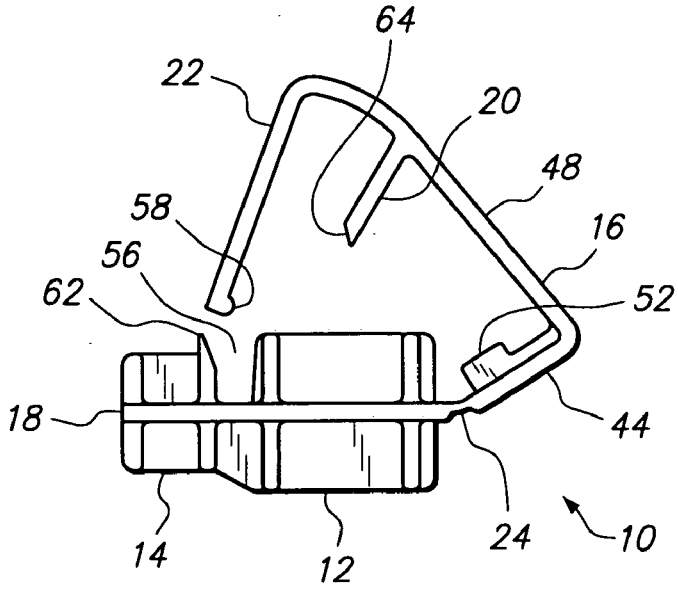
FIG. 3 is side elevational view of a first closure clip embodiment.
Figure 4:
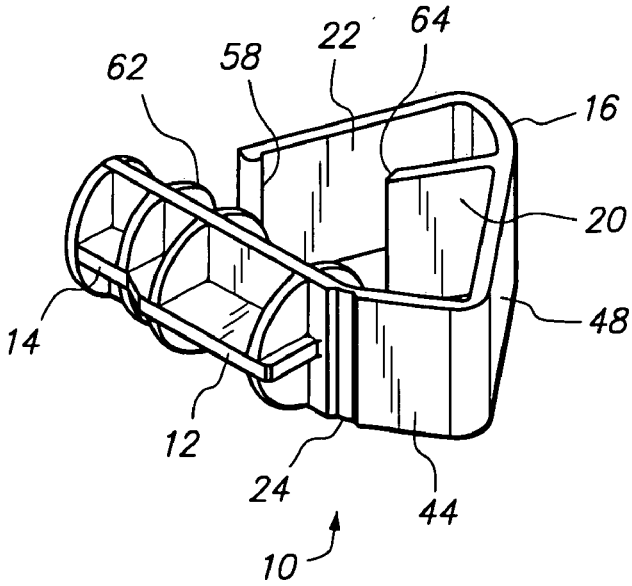
FIG. 4 is a perspective view of a first closure clip embodiment.

The closure clip 10 may be produced in different sizes for use with various commonly employed interior and entry doors. FIGS. 3 and 4 show a closure clip 10 adapted for use with commonly sized interior doors, such as interior flat jamb doors with 2⅜" backset with left or right hand swing and exterior doors with 2⅜" backset with left or right hand swing. In a closure clip 10 adapted for such doors the barrel 12 and barrel extension 14 are designed to span a distance of approximately 1.89 inches, while the transverse region 44 of the fastening tab 16 can be designed to span 0.57 inch. The elongated region 48 of the fastening tab 16 will span a distance of approximately 1.44 inches from the transverse region 44 to the reveal spacer tab 20, and 0.61 inches from the reveal spacer tab 20 to the jamb secure tab 22.

Figure 5:
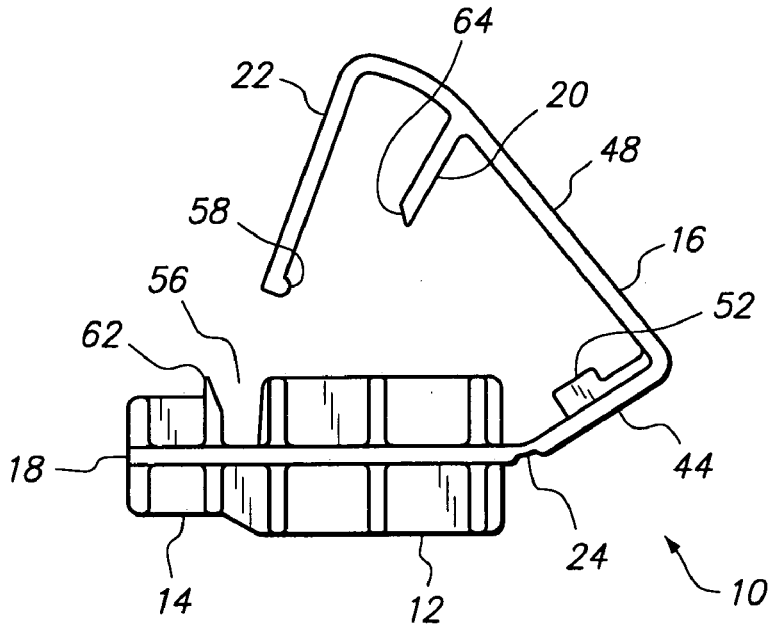
FIG. 5 is side elevational view of a second closure clip having a longer fastening tab.
Figure 6:
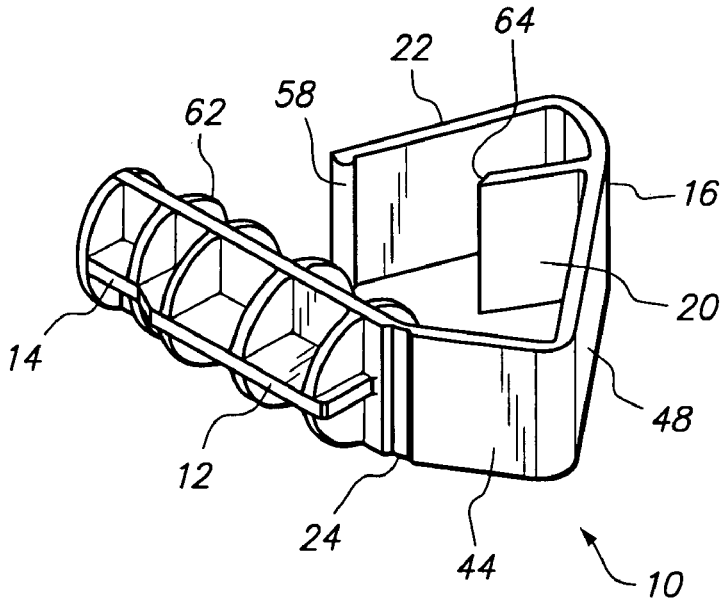
FIG. 6 is a perspective view of the second closure clip embodiment.

The closure clip 10 can also be produced for use with exterior doors with 2¾" backset with left or right hand swing (FIGS. 5 and 6). For a closure clip 10 adapted for the larger backset doors the barrel 12 and barrel extension 14 together can be designed to span a distance of approximately 2.27 inches, while the transverse region 44 of the fastening tab 16 is designed to span approximately 0.75 inch. The elongated region 48 of the fastening tab 16 will span a distance of approximately 1.78 inches from the transverse region 44 to the reveal spacer tab 20, and a similar approximately 0.61 inches from the reveal spacer tab 20 to the jamb secure tab 22. It will be observed that in FIGS. 5 and 6 the barrel comprises an additional rib over that observed for the closure clip shown in FIGS. 3 and 4.

The closure clip 10 forms a low profile on the outside of the strike jamb 34 where the jamb secure tab 22 is connected, and for this reason in many applications it may be simpler to leave the closure clip 10 in during installation of the pre-hung door assembly 28, essentially forming a temporary latch until the door has been installed. In such cases, the closure clip 10 can be removed after door installation by cutting the fastening tab 16 at the outer strike jamb surface 50, preferably as close to the jamb secure tab 22 as possible. In this alternative use, the closure clip 10 is treated as a disposable item, with the advantage that is can be left in place until the door installation is complete, with the door 32 thereby maintained in its proper aligned position through the completion of the installation process. To then remove the barrel 12 from the lockset bore 38, the jamb secure tab 22 is cut away from the remainder of the closure clip 10. It may even remain permanently attached to the outer surface 54 of the strike jamb 34 in the installed door.

Figure 7:
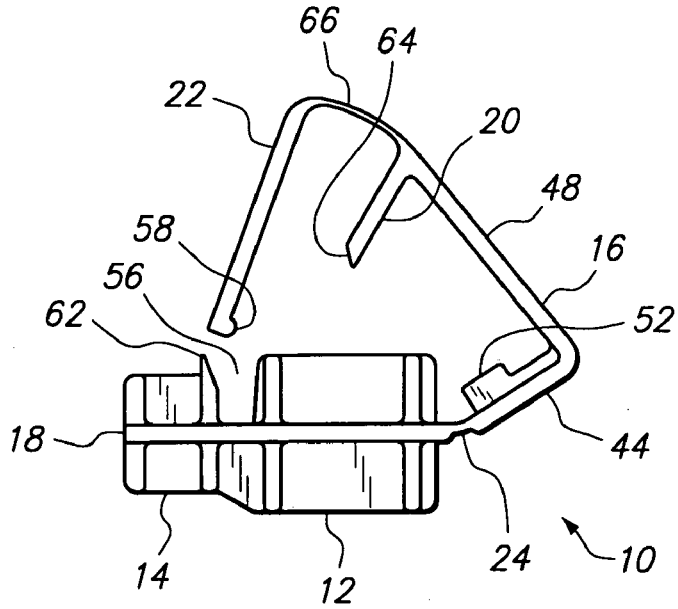
FIG. 7 is side elevational view of a third closure clip embodiment having a thinned section connecting the jamb secure tab to the fastening tab for ease of removal of the closure clip from an installed door assembly.
Figure 8:
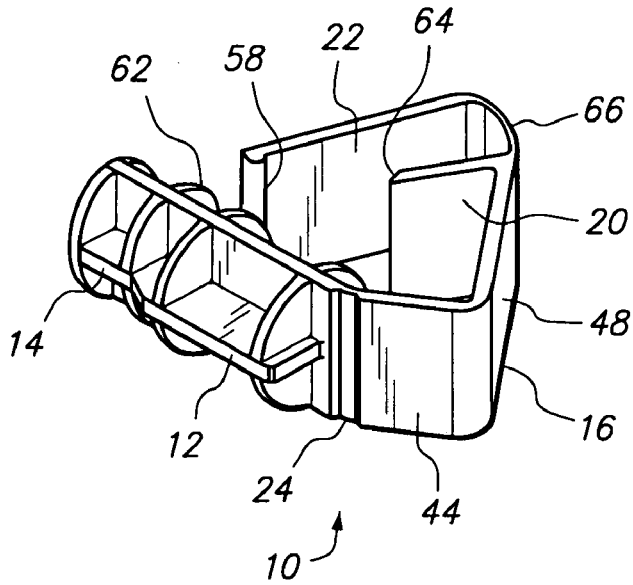
FIG. 8 is a perspective view of the third closure clip embodiment.

In one version of the closure clip a thinned section 66 is provided along the fastening tab 16 between the jamb secure tab 22 and the reveal spacer tab 20 (FIGS. 7 and 8). The dimensions of this closure clip 10 are otherwise similar to that described for the closure clip shown in FIGS. 3 and 4. The closure clip shown in FIGS. 7 and 8 can be used with interior split jamb door assemblies having a 2⅜" backset with left or right hand swing. The thinned section version is particularly useful for split jamb assemblies where the casing is installed on the jamb prior to shipping. The thinned section is able to fit under the trim piece and is easily removed, as thinning in this region of the fastening tab 16 both allows this tab to fit under the casing and makes it easier to cut the closure clip 10 free from the jamb secure tab 22, before or after installation.

Alternatively, the closure clip 10 may be reusable, in which case it will preferably be removed prior to installation of the pre-hung door assembly 28. This is accomplished simply by removing the staple securing the jamb secure tab 22 to the outer surface 54 of the strike jamb 34, and then gently pulling the barrel 12 back through the lockset bore.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. A closure clip for a pre-hung door assembly, said assembly having a door frame comprising a hinge jamb, a strike jamb and a header jamb connecting said hinge and strike jambs, and a door comprising a hinged edge mounted to said hinge jamb and a free edge opposing said strike jamb, said door further comprising a door knob bore formed in a face of said door in communication with a lockset bore formed in said free edge, wherein said space between said free edge and said lock jam defines a door reveal, and wherein said lockset bore is generally aligned with a transverse jamb bore located within said strike jamb, wherein said closure clip comprises a barrel, a barrel extension, a generally rigid fastening tab connected to said barrel opposite said barrel extension, said fastening tab having a reveal spacer tab and a jamb secure tab capable of overlaying the outer surface of the strike jamb opposite the door reveal when said barrel extension is inserted into said transverse jamb bore, and a reveal lock formed by a space between said barrel and said barrel extension accepting said spacer reveal tab.

2. The closure clip of claim 1 further comprising a flex joint disposed generally between said barrel and said fastening tab to provide movement of said fastening tab relative to said barrel.

3. The closure clip of claim 1, wherein said barrel has a diameter slightly less than the diameter of a standard lockset bore and wherein said barrel extension has a diameter slightly less than the diameter of a standard transverse jamb bore.

4. The closure clip of claim 1, wherein said barrel extension is sized to fit snugly within a standard transverse jamb bore.

5. The closure clip of claim 1, wherein said jamb secure tab comprises a terminal spacer ridge for resting on a surface of a strike jamb opposite said door reveal.

6. The closure clip of claim 1, wherein said reveal spacer tab has a tapered end for directing positioning of the reveal spacer tab into said reveal lock.

7. The closure clip of claim 1, wherein said barrel extension comprises a ridge along said reveal lock forming a jamb stop for stopping said barrel extension at a predetermined depth within said transverse jamb bore.

8. The closure clip of claim 1, whereby when said closure clip is operably fastened to said pre-hung door assembly said barrel is inserted within said lockset bore while said barrel extension is inserted within said transverse jamb bore, said fastening tab extends from said door knob bore and across a portion of a face of said door and across a portion of said strike jamb, said reveal spacer tab is inserted in said door reveal and said jamb secure tab overlays a surface of said strike jamb opposite said door reveal.

9. The closure clip of claim 8, wherein said jamb secure tab overlays said transverse jamb bore.

10. A closure clip for a pre-hung door assembly, said assembly having a door frame comprising a hinge jamb, a strike jamb and a header jamb connecting said hinge and strike jambs, and a door comprising a hinged edge mounted to said hinge jamb and a free edge opposing said strike jamb, said door further comprising a door knob bore formed in a face of said door in communication with a lockset bore formed in said free edge, wherein said space between said free edge and said lock jam defines a door reveal, and wherein said lockset bore is generally aligned with a transverse jamb bore located within said strike jamb, wherein said closure clip comprises a barrel, a barrel extension and a generally rigid fastening tab connected to said barrel opposite said barrel extension, wherein said barrel extension is generally elliptical in cross section, and wherein said fastening tab comprises a reveal spacer tab and a jamb secure tab capable of overlaying the outer surface of the strike jamb opposite the door reveal when said barrel extension is inserted into said transverse jamb bore.

11. A closure clip for a pre-hung door assembly, said assembly having a door frame comprising a hinge jamb, a strike jamb and a header jamb connecting said hinge and strike jambs, and a door comprising a hinged edge mounted to said hinge jamb and a free edge opposing said strike jamb, said door further comprising a door knob bore formed in a face of said door in communication with a lockset bore formed in said free edge, wherein said space between said free edge and said lock jam defines a door reveal, and wherein said lockset bore is generally aligned with a transverse jamb bore located within said strike jamb, wherein said closure clip comprises a barrel, a barrel extension, a generally rigid fastening tab connected to said barrel opposite said barrel extension, said fastening tab having a reveal spacer tab and a jamb secure tab, and a reveal lock formed by a space between said barrel and said barrel extension accepting said spacer reveal tab, whereby in operably fastening said closure clip to said pre-hung door assembly said barrel is inserted within said lockset bore while said barrel extension is inserted within said transverse jamb bore, said fastening tab extends from said door knob bore and across a portion of a face of said door and across a portion of said strike jamb, said reveal spacer tab is inserted in said door reveal and said jamb secure tab overlays a surface of said strike jamb opposite said door reveal and overlaying said transverse jamb bore.

12. The closure clip of claim 11 further comprising a flex joint disposed generally between said barrel and said fastening tab to provide movement of said fastening tab relative to said barrel.

13. The closure clip of claim 11, wherein said barrel has a diameter slightly less than the diameter of a standard lockset bore and wherein said barrel extension has a diameter slightly less than the diameter of a standard transverse jamb bore.

14. The closure clip of claim 11, wherein said barrel extension is sized to fit snugly within a standard transverse jamb bore.

15. The closure clip of claim 11, wherein said jamb secure tab comprises a terminal spacer ridge for resting on a surface of a strike jamb opposite said door reveal.

16. The closure clip of claim 11, wherein said barrel extension is generally elliptical in cross section.

17. The closure clip of claim 11, wherein said reveal spacer tab has a tapered end for directing positioning of the reveal spacer tab into said reveal lock.

18. The closure clip of claim 11, wherein said barrel extension comprises a ridge along said reveal lock forming a jamb stop for stopping said barrel extension at a predetermined depth within said transverse jamb bore.

* * * * *